US012484711B1

(12) United States Patent
Bisgaard

(10) Patent No.: US 12,484,711 B1
(45) Date of Patent: Dec. 2, 2025

(54) APPARATUS AND METHOD FOR FURNITURE WITH ADJUSTABLE PLATFORM HEIGHT AND MEMBRANE SIDEWALLS

(71) Applicant: John R. Bisgaard, Roseville, MN (US)

(72) Inventor: John R. Bisgaard, Roseville, MN (US)

( * ) Notice: Subject to any disclaimer, the term of this patent is extended or adjusted under 35 U.S.C. 154(b) by 313 days.

(21) Appl. No.: 18/202,279

(22) Filed: May 25, 2023

Related U.S. Application Data

(60) Provisional application No. 63/345,849, filed on May 25, 2022.

(51) Int. Cl.
*A47D 9/00* (2006.01)
*A47C 3/32* (2006.01)

(52) U.S. Cl.
CPC ..... *A47D 9/012* (2022.08); *A47C 3/32* (2013.01)

(58) Field of Classification Search
CPC ..... A47D 9/00; A47D 9/005; A47D 9/008; A47D 9/012; A47D 9/016; A47D 7/00; A47D 7/002; A47D 7/005; A47D 7/007; A47D 7/01; A47D 7/02; A47D 7/03; A47D 7/04; A47D 11/00; A47D 11/005; A47D 11/007; A47D 13/00; A47D 13/06; A47D 13/061; A47D 13/063; A47D 13/065; A47D 13/066; A47D 13/068; A47C 3/32
See application file for complete search history.

(56) References Cited

U.S. PATENT DOCUMENTS 1,588,573 A * 6/1926 Edmiston ..... A61G 7/1044 5/302
2,599,296 A * 6/1952 Toomey ..... A47D 7/03 5/93.1
2,658,207 A * 11/1953 Robbins ..... A47D 7/03 5/93.1
3,541,619 A * 11/1970 Morrison ..... A47D 7/02 5/100
3,848,277 A * 11/1974 Reguitti ..... A47D 9/012 5/93.1
4,285,079 A * 8/1981 Hillman ..... A47D 9/012 5/93.1
4,837,877 A * 6/1989 Hamada ..... A47C 17/84 5/10.2
4,998,939 A * 3/1991 Potthast ..... A61G 7/052 5/424
5,214,808 A * 6/1993 Schoonover ..... A47D 7/02 5/100
5,349,709 A * 9/1994 Cheng ..... A47D 9/016 5/93.1
5,802,634 A * 9/1998 Onishi ..... A47G 1/06 5/93.1

(Continued)

FOREIGN PATENT DOCUMENTS

WO WO_2014027216 2/2014

*Primary Examiner* — George Sun
(74) *Attorney, Agent, or Firm* — Charles A. Lemaire; Lemaire Patent Law Firm, P.L.L.C.

(57) ABSTRACT

A method and corresponding apparatus that includes: a frame; one or more adjustable-height sidewalls connected to the frame, wherein the sidewalls are selectively raisable; a body support platform; and a membrane that is connected to the frame and extends from the frame over the sidewalls and is configured to support the body support platform within the one or more sidewalls at any selected one of a plurality of different heights.

23 Claims, 8 Drawing Sheets

(56) References Cited

U.S. PATENT DOCUMENTS 6,332,231 B1 * 12/2001 Wang ..... A47D 5/00 5/503.1
6,339,855 B1 * 1/2002 Socha ..... A47D 9/012 5/93.1
8,484,774 B2 * 7/2013 Cohen ..... A47D 7/03 5/93.1
8,528,130 B2 * 9/2013 Bu ..... A47D 9/016 5/655
8,640,280 B2 * 2/2014 Gutierrez ..... A47D 9/012 5/100
8,646,126 B2 * 2/2014 Carta ..... A47D 7/02 5/100
9,675,183 B2 * 6/2017 Saint ..... A47D 13/063
9,706,854 B1 * 7/2017 Zhou ..... A47D 13/06
9,763,523 B2 * 9/2017 Thomson ..... A47D 13/066
11,083,310 B2 * 8/2021 Matsumoto ..... A47D 11/00
11,759,026 B1 * 9/2023 Lawlor ..... A47D 7/005 5/93.1
2003/0135923 A1 * 7/2003 Godin ..... A47D 7/02 340/568.1
2004/0154099 A1 * 8/2004 Waters ..... A47G 9/0253 5/655
2006/0075565 A1 * 4/2006 Agre ..... A47D 9/04 5/660
2009/0049605 A1 * 2/2009 Zhao ..... A47D 15/00 5/93.1
2009/0070929 A1 * 3/2009 Holman ..... A47D 7/03 5/93.1
2010/0017959 A1 * 1/2010 Yoshe ..... A47D 9/016 5/99.1
2016/0183695 A1 * 6/2016 Veron ..... G08B 21/0205 5/93.1
2018/0206651 A1 * 7/2018 Gallina ..... A47D 9/005
2024/0138588 A1 * 5/2024 Da Silva Neto ..... A47D 9/012

* cited by examiner

APPARATUS AND METHOD FOR FURNITURE WITH ADJUSTABLE PLATFORM HEIGHT AND MEMBRANE SIDEWALLS

CROSS-REFERENCE TO RELATED APPLICATION

This application claims priority benefit, under 35 U.S.C. § 119 (e), of U.S. Provisional Patent Application 63/345,849 titled "SAFETY CRIB AND METHOD" filed May 25, 2022, which is hereby incorporated by reference in its entirety.

FIELD OF THE INVENTION

This invention relates to the field of adjustable beds, and more specifically to a method and apparatus of selectively adjusting a height of a body support platform with respect to protective sidewalls, by, for example, raising and lowering sidewall frame top rail within a constrained sidewall membrane and/or collecting and releasing the membrane while maintaining the frame top rail at a substantially fixed sidewall height.

BACKGROUND OF THE INVENTION

Cribs, bassinets and beds for infants and young children must have high side walls to prevent the child in question from climbing out. However, high side walls make it difficult for parents to set already sleeping children into the crib without waking them. In the past, this was addressed by the use of drop-side cribs. Since drop-side cribs have proven to be profoundly unsafe, there remains a need in the art for a safe crib of adjustable side-wall height.

Infants and young children cannot safely sleep in a bed that lacks protective sidewalls, due to the risk of falling. However, sidewalls require that parents lean down over the sidewalls to set the infant or child on the mattress, frequently after the difficult work of coaxing the infant to sleep. With sidewall heights greater than a few inches, it becomes difficult to set the infant or child down gently from a cradled position, especially for parents and caregivers with back problems or other physical limitations.

Although there are currently available mattresses that allow adjustments to the height of the sidewall with respect to the mattress (generally by lowering the mattress to fixed points on the frame), these adjustments are performed by means of a partial disassembly of the crib for the sake of providing higher sidewalls for older children who are both more capable of climbing and, it is hoped, tolerant of more jostling as they are placed inside. Thus these adjustments cannot be performed while the crib is occupied.

Historically, drop-side cribs were developed to provide an easier reach into the crib, allowing the infant or child to be more gently placed onto the mattress. However, these were responsible for a number of injuries and fatalities by entrapment between the mattress and the sidewall, and by inadvertent operation of the drop-side structure.

U.S. Pat. No. 2,599,296, issued Jun. 3, 1952 to Toomey et al. and titled "Utility height adjustable crib," is incorporated herein by reference.

U.S. Pat. No. 3,541,619, issued Nov. 24, 1970 to Morrison and titled "Drop side crib," is incorporated herein by reference. U.S. Pat. No. 3,541,619 describes a drop side crib having a drop side extending between a pair of opposed crib ends and vertically movable with respect thereto. The drop side has upper and lower rails each of which is formed with a pair of opposed end notches extending vertically through the rail. The pair of opposed crib ends fixedly carry elongated substantially rigid guides which extend upwardly beyond bottom edges of the crib ends toward top edges thereof. These guides are respectively provided with inwardly extending guide ribs extending inwardly toward each other away from the crib ends. The guide ribs are respectively received in the notches at the ends of the rails of the drop side so as to guide the latter for vertical movement with respect to the crib ends.

PCT Application Publication WO 2014/027216 by Werner published on Feb. 20, 2014 with the title "Baby crib with automatic lifting device," and is incorporated herein by reference. Publication WO 2014/027216 describes fit to ease nursing babies, i.p. laying them down to sleep without interruptive motion, a lifting device (6,7) for cribs (1) is proposed, that would lower a level plate (3) with a mattress on it smoothly from a high position—also suitable for changing diapers—to a safe sleeping and playing position.

There remains a need in the art for an improved safety crib that addresses shortcomings of the prior art.

SUMMARY OF THE INVENTION

Certain marks referenced herein may be common-law or registered trademarks of third parties affiliated or unaffiliated with the applicant or the assignee. Use of these marks is for providing an enabling disclosure by way of example and shall not be construed to limit the scope of the claimed subject matter to material associated with such marks.

In some embodiments the present invention includes a body support platform suspended by one or more selectively adjustable membranes extending from the body support platform over one or more sidewalls that have selectively adjustable heights.

In some embodiments, the present invention includes a rigid or semi-rigid bed surface configured to support a human (e.g., a baby); a vertically-moveable wall encircling the bed surface but not fastened to, and not in a permanent spatial relationship to, the bed surface; a flexible membrane or fabric supporting, and optionally fastened to the perimeter of, the bed surface. This membrane or fabric extends over the vertical wall from the bed surface to an attachment point outside the vertical wall. The edge of the membrane or fabric is constrained along the outer edge. In some embodiments, a mechanism or actuator is provided to effect relative motion between the wall and the membrane configured to lift the bed surface with respect to the wall. In some embodiments, this vertical motion between the wall and the membrane is achieved by a vertical motion mechanism configured to raise and lower the wall with respect to a base to which the outer edge of the membrane is rigidly connected. In some other embodiments, the wall is rigidly connected to the crib base, and a mechanism is provided to raise and lower the outer edge of the membrane. In some embodiments, the outer edge is affixed to an outer frame to facilitate the raising and lowering of the bed surface. The raising and lowering mechanism may include pneumatic or hydraulic pistons, lead screws, motors, rack-and-pinion mechanisms, pulleys linear motors, or other suitable mechanisms. In some embodiments, the raising-and-lowering mechanism is electrically actuated. The likelihood entrapment of the occupant is reduced or eliminated by a combination of the rigidity of the membrane, the elasticity of the membrane, the tension on the membrane, and/or the forms of the membrane and other elements.

In some embodiments, the outer edge of the membrane is formed into filaments or straps, and motion of the membrane is achieved by winding these straps or filaments onto motorized spools or rollers. To reduce wear on the membrane as the membrane is moved across the top rails, in some embodiments the shape of the top rails, the outer attachment points, and/or the mattress has rounded corners, such as ellipsoidal or other curved shape, to avoid stretching the membrane around sharp corners. In some embodiments, a plurality of rollers are mounted to the top of the wall to reduce friction on the membrane.

In some embodiments, there are additional linkages, further constraining the motion of the bed surface. In some embodiments, the bed surface and flexible membrane are fabricated together as a single piece of formed material.

In some embodiments, the present invention includes a control system operably connected to the motion actuators that control the movement and position of the various parts of the present invention, to their desired points.

In some embodiments, the control system optionally includes additional functionality, such as video and/or audio monitoring, entertainment, and communication.

In some embodiments, the present invention provides an apparatus that includes: a frame; one or more adjustable-height sidewalls connected to the frame, wherein the sidewalls are selectively raisable and lowerable to any one of a plurality of selected heights by electric, pneumatic, hydraulic, mechanical, or other means; a body support platform; and a membrane that is connected to the frame and extends from the frame over the sidewalls and is configured to support the mattress within the one or more sidewalls at any selected one of a plurality of different heights.

In some other embodiments, the present invention provides an apparatus that includes: a frame; one or more fixed height sidewalls connected to the frame; a mattress; a membrane that is configured to support the mattress and extends over the sidewalls; and pulleys or other electric, pneumatic, hydraulic, mechanical or other means to provide motive force to the membrane, effecting a raising and lowering of the mattress with respect to the sidewalls.

In some other embodiments, the present invention provides an apparatus that includes: a frame; a mattress; one or more sidewalls having an electromechanically adjustable height; a membrane which is configured to support the mattress and which extends over the sidewalls; and pulleys or other electric, pneumatic, hydraulic, mechanical or other means to provide motive force to pull or release the membrane, effecting a raising and lowering of the mattress with respect to the sidewalls.

In some embodiments, the membrane is a single piece, with no gaps.

In some embodiments, the friction on the membrane where it passes over the sidewall is reduced by one or more of: bearings; bushings; and rollers.

In some embodiments, the present invention is configured for use as a crib.

In some embodiments, the motive force for effecting motion of the sidewalls and/or the membrane is manually provided by the human parent or caretaker operating the crib.

In some embodiments, the motive force is provided electromechanically by a control system under control of the human parent or caretaker operating the crib.

In some embodiments, the control system includes motion sensors, infrared temperature sensors, visual or infrared vision systems, mechanical or electronic switches, chemical sensors, and/or electronic sensors for monitoring the health of and detecting motion of the crib occupant.

In some embodiments, the control system is capable of automatic action. In some embodiments, this is an automatic reaction to raise the sidewalls to greater height in response to a sensed motion.

In some embodiments, the membrane is sufficiently stiff and under sufficient tension, and the gaps in the sidewall structure are sufficiently small or sufficiently large, and are appropriately shaped such that formation of a pocket of membrane material able to cause entrapment of any portion of the occupant is prevented, both when in motion and while static.

In some embodiments of the apparatus, the membrane includes a woven fabric, such as cotton canvas, polyester, or polymer. In some embodiments, the membrane includes a non-woven spunbond fabric made from one or more polymers.

In some embodiments of the apparatus, the membrane is a woven fabric, such as cotton canvas, polyester, or woven or non-woven polymer.

In some embodiments of the apparatus, the membrane is composed of one or more polymers.

In some embodiments of the apparatus, the membrane includes a fabric.

In some embodiments of the apparatus, the membrane includes a polymer sheet.

In some embodiments of the apparatus, the membrane includes an elastomeric sheet.

In some embodiments of the apparatus, the membrane includes a rubber sheet or layer.

In some embodiments, the body support platform includes a structured thickening of the membrane, such that there is no gap between the body support platform and the membrane.

In some embodiments, the apparatus includes a mattress supported by the body support platform. In some other embodiments, the body support platform is a mattress.

In some embodiments of the apparatus, the membrane has a bottom portion that fits snugly around the perimeter of the mattress.

In some embodiments of the apparatus, the mattress has a nominal crib size of 51.25 inches by 27.25 inches (130 cm by 69 cm).

In some embodiments of the apparatus, the mattress has a nominal size of 38 inches by 24 inches (97 cm by 61 cm).

In some embodiments of the apparatus, the mattress has a standard nominal cot size of 75 by 30 inches (190 cm by 76 cm)

In some embodiments of the apparatus, the mattress has a standard nominal twin size of 75 inches by 38 inches (190 cm by 97 cm).

In some embodiments of the apparatus, the mattress has a standard nominal twin XL size of 80 inches by 38 inches (203 cm by 97 cm).

In some embodiments of the apparatus, the mattress has a standard nominal full size of 75 by 54 inches (190 cm by 137 cm).

In some embodiments of the apparatus, the mattress has a standard nominal queen size of 80 by 60 inches (203 cm by 152 cm).

In some embodiments of the apparatus, the mattress is a standard nominal king size of 80 by 54 inches (203 cm by 137 cm).

In some embodiments, the present invention provides a crib that includes: a frame; one or more fixed-height sidewalls connected to the frame; a mattress; a membrane dispensing system operably coupled to the frame and configured to selectively collect or release a membrane from the frame, wherein the membrane is connected to the membrane dispensing system and extends from the membrane-dispensing system over the sidewalls and is configured to support the mattress within the one or more sidewalls, wherein the membrane-dispensing system selectively collects or releases the membrane in order to raise and lower the mattress within the sidewalls to a selected one of a plurality of different heights. In some embodiments, the height is continuously adjustable.

In some embodiments, the crib includes a controller operably coupled to one or more of the adjustable-height sidewalls and the membrane-dispensing system. The controller is furthermore operably coupled to one or more switches, sensors, microphones, visual-light cameras, or infrared cameras. In some embodiments, the controller functions include measurement of motor voltage, current, and/or power.

In some embodiments, the controller is configured to automatically adjust the body support platform in response to the condition and disposition of the occupant.

In some embodiments, the controller is configured to provide an alert to human parents or caretakers of the occupant of the crib regarding changes in the condition or disposition of the occupant. In some implementations, this alert includes one or more of audio or visual signals on the crib, or output of a cell phone connected via a network connection to the crib. In some other embodiments, the apparatus is a bed for an adolescent or an adult, and the controller is configured to provide an alert to the occupant of the bed, regarding changes in the occupant's condition that the occupant may not be aware of.

In some embodiments, the controller is configured to receive software updates via a network connection. In some embodiments, the controller is configured to access media, such as entertainment media, via a network connection.

In some embodiments, the crib includes a bracing point for the human parent or caretaker to help avoid overbalancing of the parent or caretaker when placing the child in the crib. In some embodiments, the bracing point is configured to be grabbed by an orientation of the leg of the parent or caretaker. In some other embodiments, the bracing point is a lip against which the parent or caretaker can brace a foot.

In some embodiments, the crib provides a step for the convenience of small-statured parents and caretakers in reaching over the sidewall.

In some embodiments, the internal sidewall structure includes a top rail configured to reduce wear or friction with the membrane. In some embodiments, this top rail is integral to the internal sidewall structure. In some other embodiments, the top rail is a separate piece.

In some embodiments, the top rail includes one or more rotating segments having bearings or bushings to reduce friction.

In some embodiments the outer surface of the top rail is coated with a low-friction polymer, such as Teflon®, Nylon®, polyethylene, polypropylene, or other suitable low-friction or slippery material. In some embodiments the outer surface is additionally or alternatively coated with a suitable lubricant, such as graphite, silicone, or other oil.

Thus, in some embodiments, the present invention provides a crib with raisable sidewalls and a membrane envelope that slides over the raisable sidewalls to raise and lower a mattress within the sidewalls. The invention provides a simple and convenient solution to the problem of accessing the baby in the crib, particularly for parents who have physical limitations or back problems. The invention can be easily implemented and is adaptable to different crib sizes and mattress sizes.

In some embodiments, the apparatus includes a canopy, which optionally functions as a display screen for the entertainment of the occupant. In some embodiments, the apparatus also includes a sound system. In some embodiments, the media content presented by the audiovisual system is dynamically adjusted according to the condition and disposition of the occupant.

In some embodiments, the apparatus is configured for use as a chair, with two armrest sidewalls/siderails and a backrest sidewall/siderail.

In some embodiments, the armrest sidewalls have different heights. In some embodiments, the heights of the armrest sidewalls are different from the height of the backrest sidewall.

In some embodiments, the selective differential motion of the one or more sidewalls and/or the one or more membranes permits the body support platform to be tilted.

In some embodiments, one or more locking mechanisms are provided for a subset of the plurality of positions of the sidewall.

In some embodiments, one or more braking mechanisms are provided to selectively arrest motion of the actuators. In some embodiments, the braking mechanisms are configured to arrest motion of the apparatus when unpowered.

In some embodiments, the membrane forms an airtight chamber with the frame and the body support platform, the sidewalls lack an inner support structure, and the raising and lowering of the sidewalls is effected by adding or removing air from the airtight chamber. In some such embodiments, the body support platform is affixed or tethered to the frame. In some embodiments, an air-mattress is used on the body support platform, and the thickness of the air-mattress, and thus the height of its top surface, is adjustable by adding or subtracting air from the air-mattress.

The description provided herein lists certain elements used in various embodiments. In other embodiments, combinations and subcombinations of the elements are used to provide other functions or combinations of functions. Elements named in connection with a particular embodiment may be appropriate to other embodiments in combinations which will be apparent to those of skill in the art.

DETAILED DESCRIPTION OF THE INVENTION

Although the following detailed description contains many specifics for the purpose of illustration, a person of ordinary skill in the art will appreciate that many variations and alterations to the following details are within the scope of the invention. Specific examples are used to illustrate particular embodiments; however, the invention described in the claims is not intended to be limited to only these examples, but rather includes the full scope of the attached claims. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. The embodiments shown in the Figures and described here may include features that are not included in all specific embodiments. A particular embodiment may include only a subset of all of the features described, or a particular embodiment may include all of the features described.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

Figure 1:
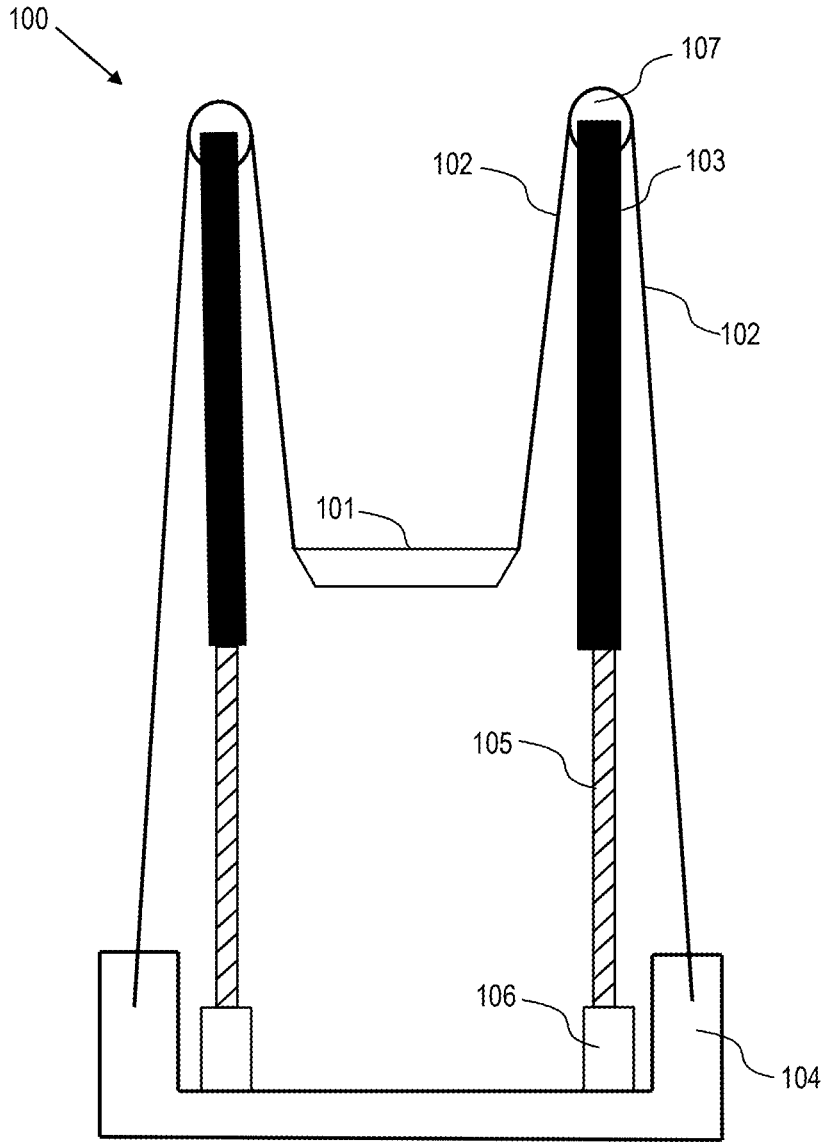
FIG. 1 is a section view of an illustrative embodiment of the present invention.

FIG. 1 is a section view of an illustrative system 100 of the present invention. The body support platform 101 is suspended from a continuous membrane 102, which on the other end is rigidly affixed to the frame 104. The membrane passes over a low-friction curved surface 107 on top of the internal sidewall structure 103, which is operatively coupled to leadscrews 105 driven by a rotary motor 106 under control of a controller not shown.

Figure 2:
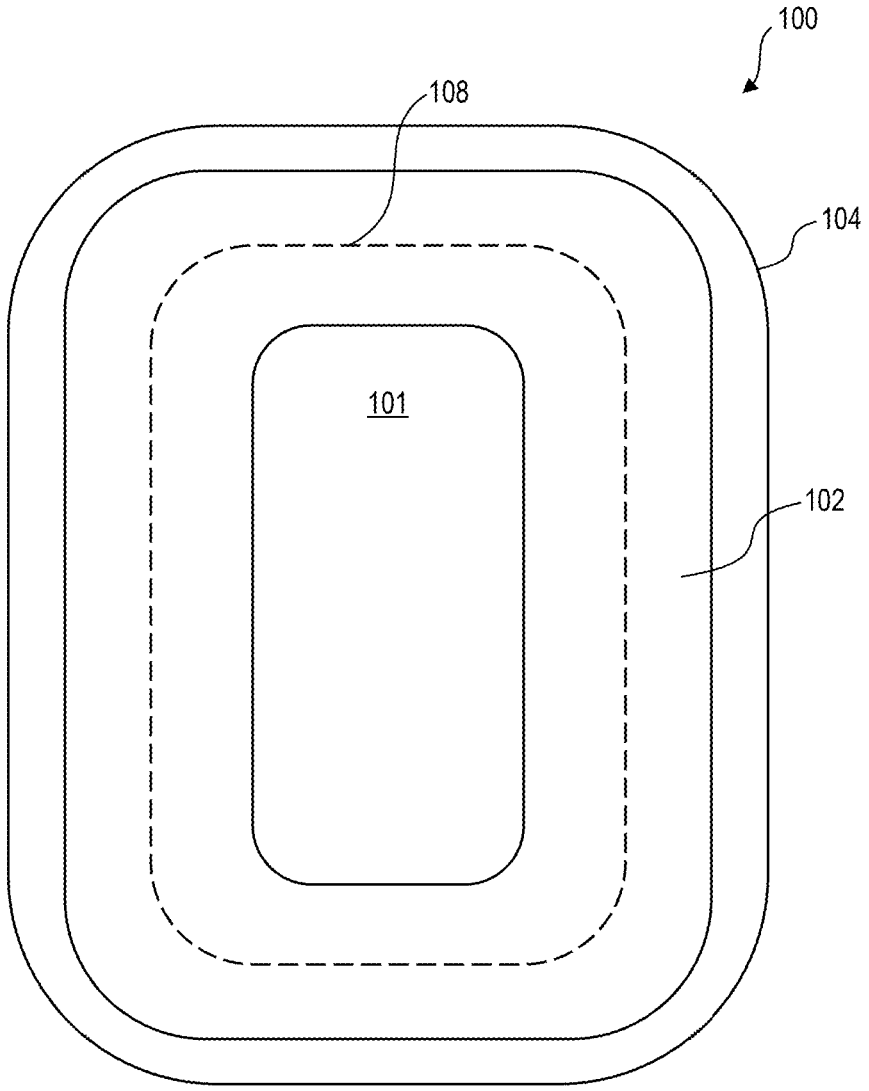
FIG. 2 is a plan view of an illustrative embodiment of the present invention.

FIG. 2 is a plan view of the system 100 shown FIG. 1. The rim of the sidewall 108 is shown.

Figure 3:
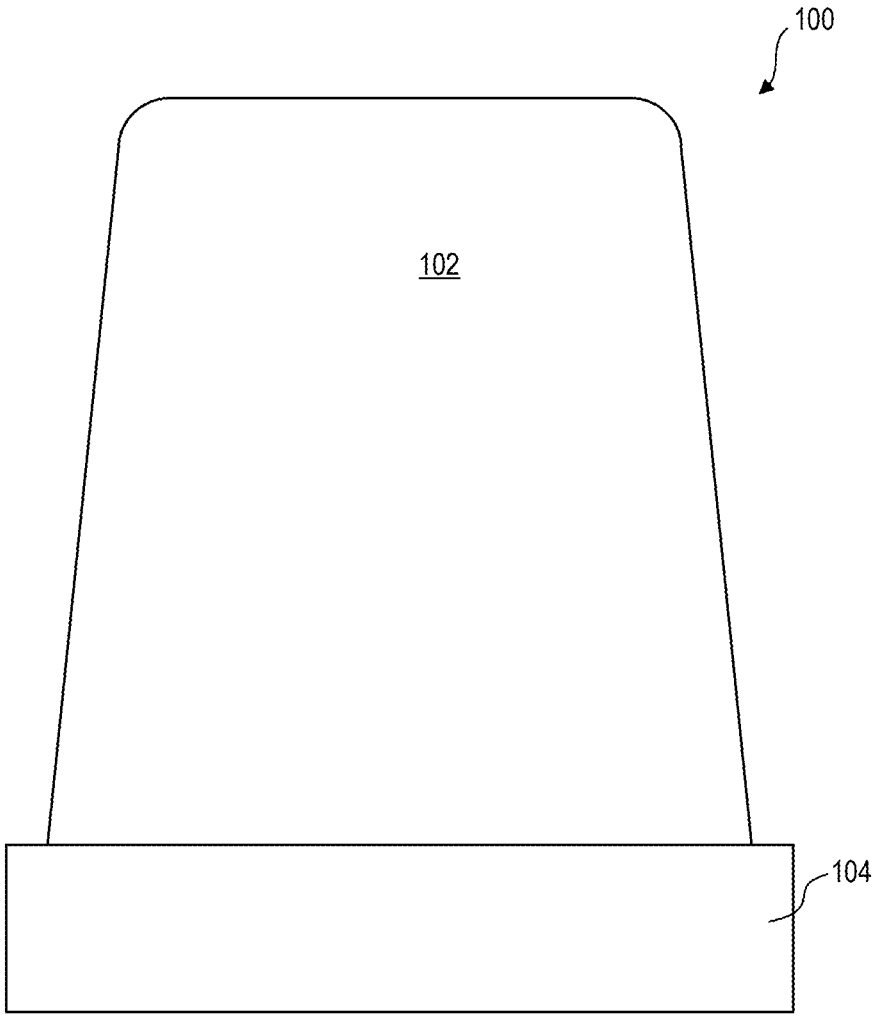
FIG. 3 is an elevation view of an illustrative embodiment of the present invention.

FIG. 3 is an elevation view of system 100 described above FIG. 1.

Figure 4A:
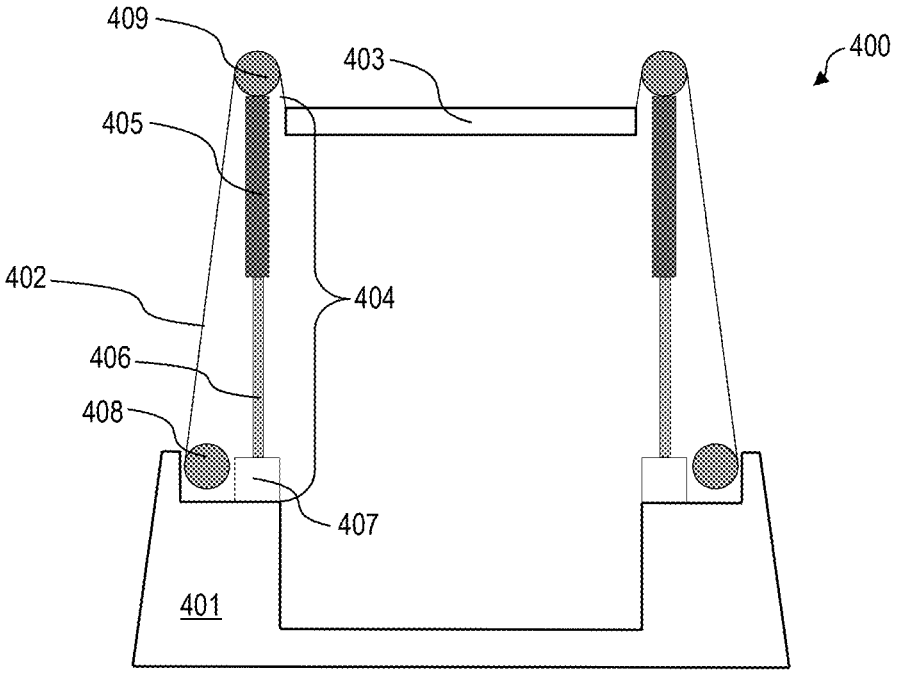
FIG. 4A is a section view of an illustrative embodiment of the invention with body support platform fully raised.

FIG. 4A is a section view of system 400, which is another illustrative embodiment of the invention with body support platform fully raised. In some embodiments, system 400 includes frame 401 holds a motorized roller 408 and a movable sidewall assembly 404. The movable sidewall assembly 404 includes a leadscrew 406 operatively coupled to the internal sidewall structure 405, and a motorized mount 407. The membrane 402 extends from the body support platform 403, up and over a low-friction bushing 409 mounted on the top edge of the sidewall mounted on the top edge of the sidewall 404, and down to a motorized roller 408 to which it is attached. The motorized roller 408 collects and dispenses membrane material in order to raise and lower the body-support platform 403. Raising and lowering the sidewall 405 additionally raises and lowers the body support platform 403 with respect to the sidewall 405.

Figure 4B:
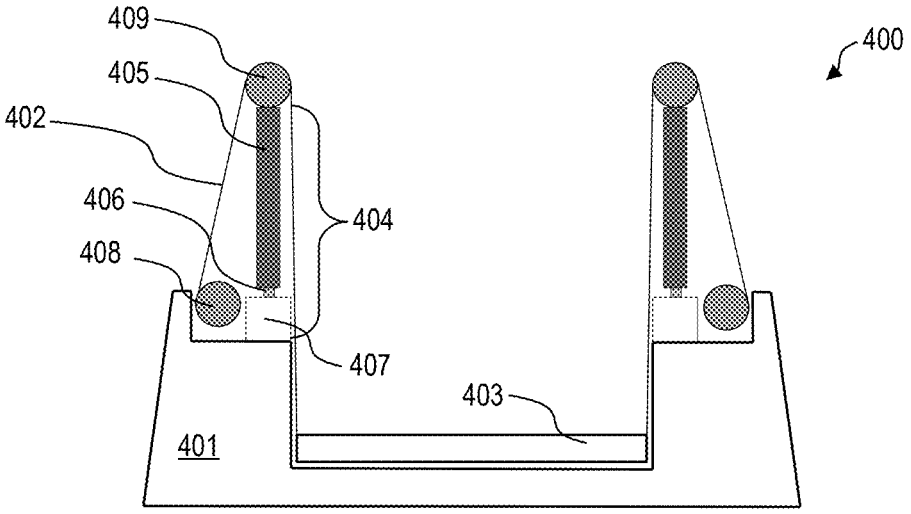
FIG. 4B is a section view of an illustrative embodiment of the invention with body support platform fully lowered.

FIG. 4B is a section view of system 400 described above FIG. 4A, with the body support platform 403 fully lowered.

Figure 5A:
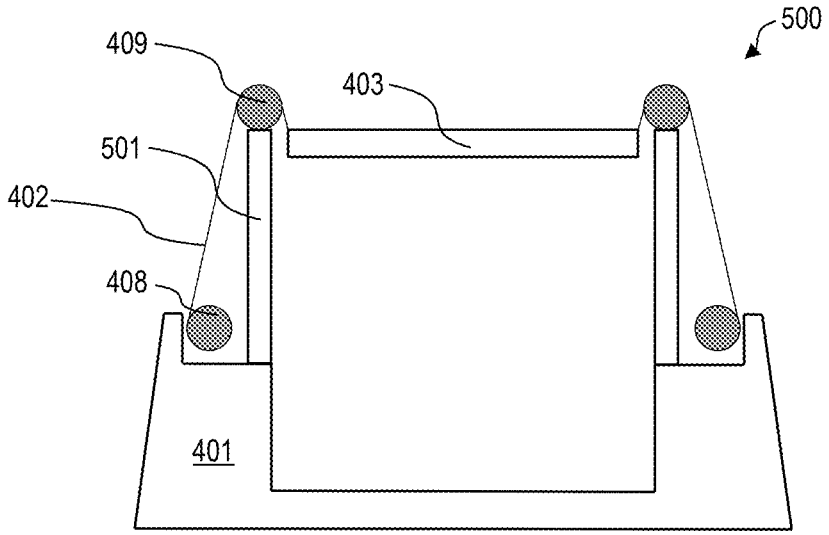
FIG. 5A is a section view of a variation of the invention having a fixed-height sidewall with the body support platform fully raised.

FIG. 5A is a section view of a system 500 having a fixed-height sidewall 501 with the body support platform 403 fully raised. A motorized roller 408 and fixed internal sidewall structure 501 are attached to the frame 401. The membrane 402 extends from the body support platform 403, up and over a low-friction bushing 409 mounted on the top edge of the internal sidewall structure 501, and down on the outside of the sidewall structure 501 to the motorized roller 408 to which it is attached. The motorized roller 408 collects and dispenses membrane material in order to raise and lower the body support platform 403.

Figure 5B:
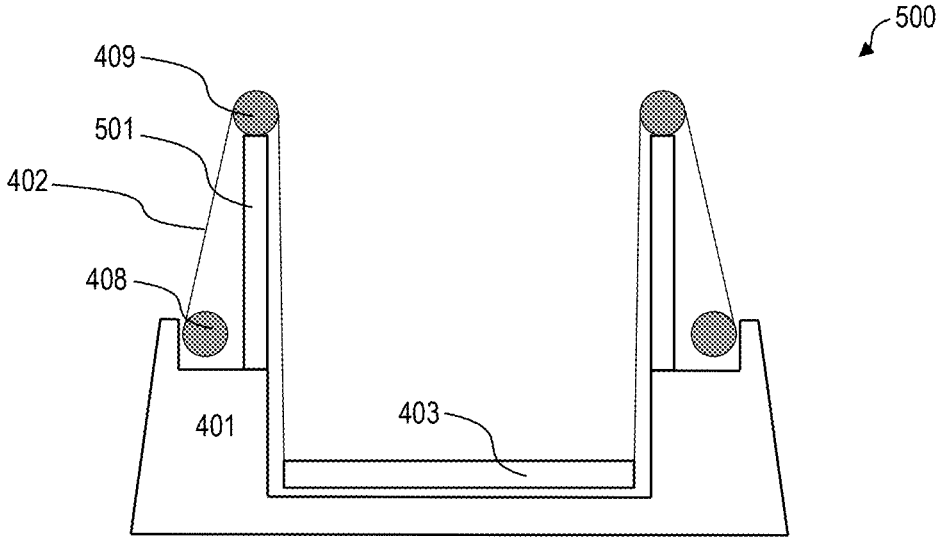
FIG. 5B is a section view of a variation of the invention having a fixed-height sidewall with the body support platform fully lowered.

FIG. 5B is a section view of system 500, with the body support platform fully lowered.

Figure 6A:
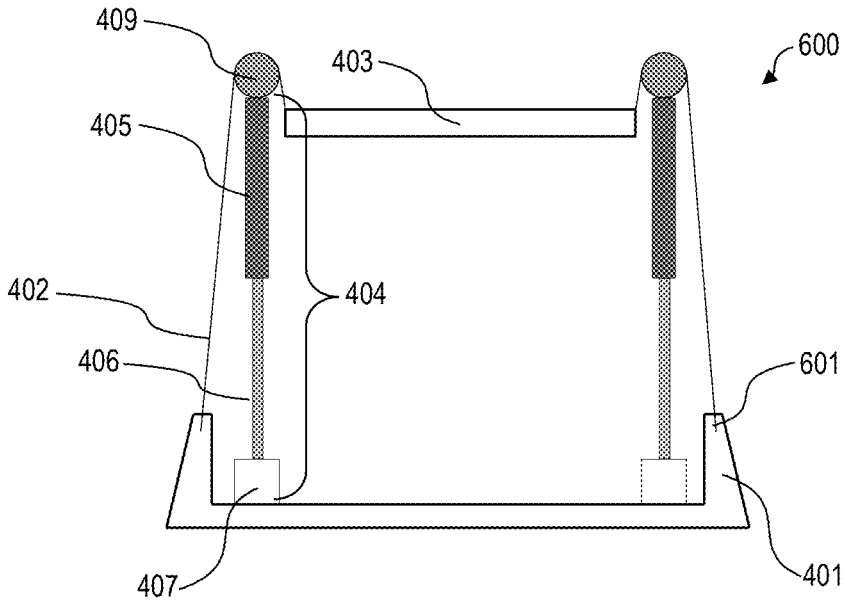
FIG. 6A is a section view of a variation of the invention having a membrane with a fixed outer edge with the body support platform fully raised.

FIG. 6A is a section view of a system 600 according to some embodiments of the invention. In some embodiments, system 600 is substantially equivalent to system 100 described above, having a membrane with an outer edge affixed to frame 401, shown here with the body support platform 403 fully raised. In some embodiments, the frame 401 is attached to the movable sidewall assembly 404. The movable sidewall assembly 404 includes a leadscrew 406, operably coupled to the internal sidewall structure 405, and a motorized mount 407. The membrane 402 extends from the body support platform 403, up and over a low-friction bushing 409 mounted on the top edge of the sidewall assembly 404, and down to a rigid attachment 601 on the frame 401. Raising and lowering the sidewall structure 405 additionally raises and lowers the body support platform 403 with respect to the sidewall structure 405.

Figure 6B:
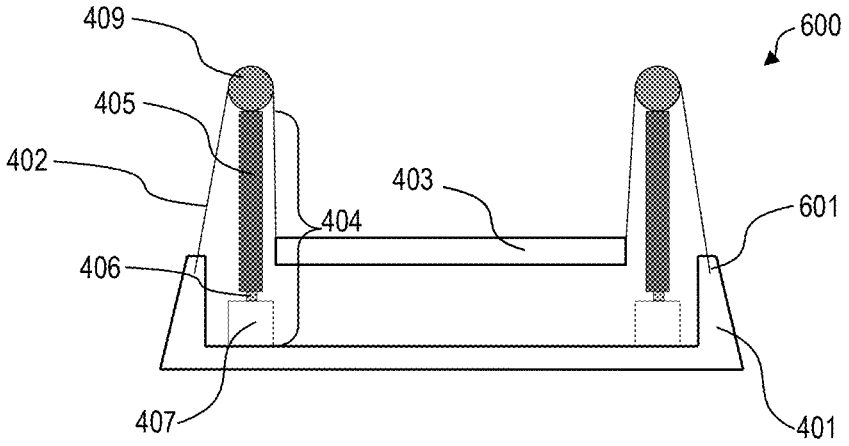
FIG. 6B is a section view of a variation of the invention having a membrane with a fixed outer edge with the body support platform fully lowered.

FIG. 6B is a section view of a system 600, having a membrane with an outer edge affixed to frame 401, shown here with the body support platform 403 fully lowered.

Figure 7:
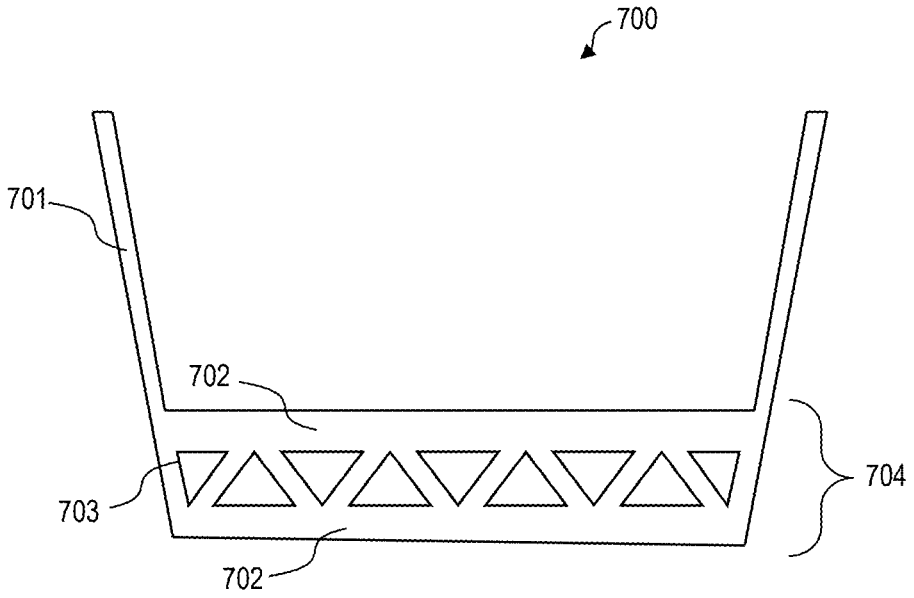
FIG. 7 is a detail section view of an illustrative implementation of a body support platform comprising a thickening and structuring of the membrane.

FIG. 7 is a cross-section view of membrane-and-body-support system 700. In some embodiments, membrane-and-body-support system 700 includes body-support platform 704 formed by a thickening 702 and structuring 703 of a central portion of the membrane 701. In some embodiments, membrane-and-body-support system 700 replaces membrane 102 and body-support platform 101 of FIG. 1, FIG. 2, and FIG. 3. In some embodiments, membrane-and-body-support system 700 replaces membrane 402 and body-support platform 403 of FIGS. 4A, 4B, 5A, 5B, 6A and 6B.

Figure 8:
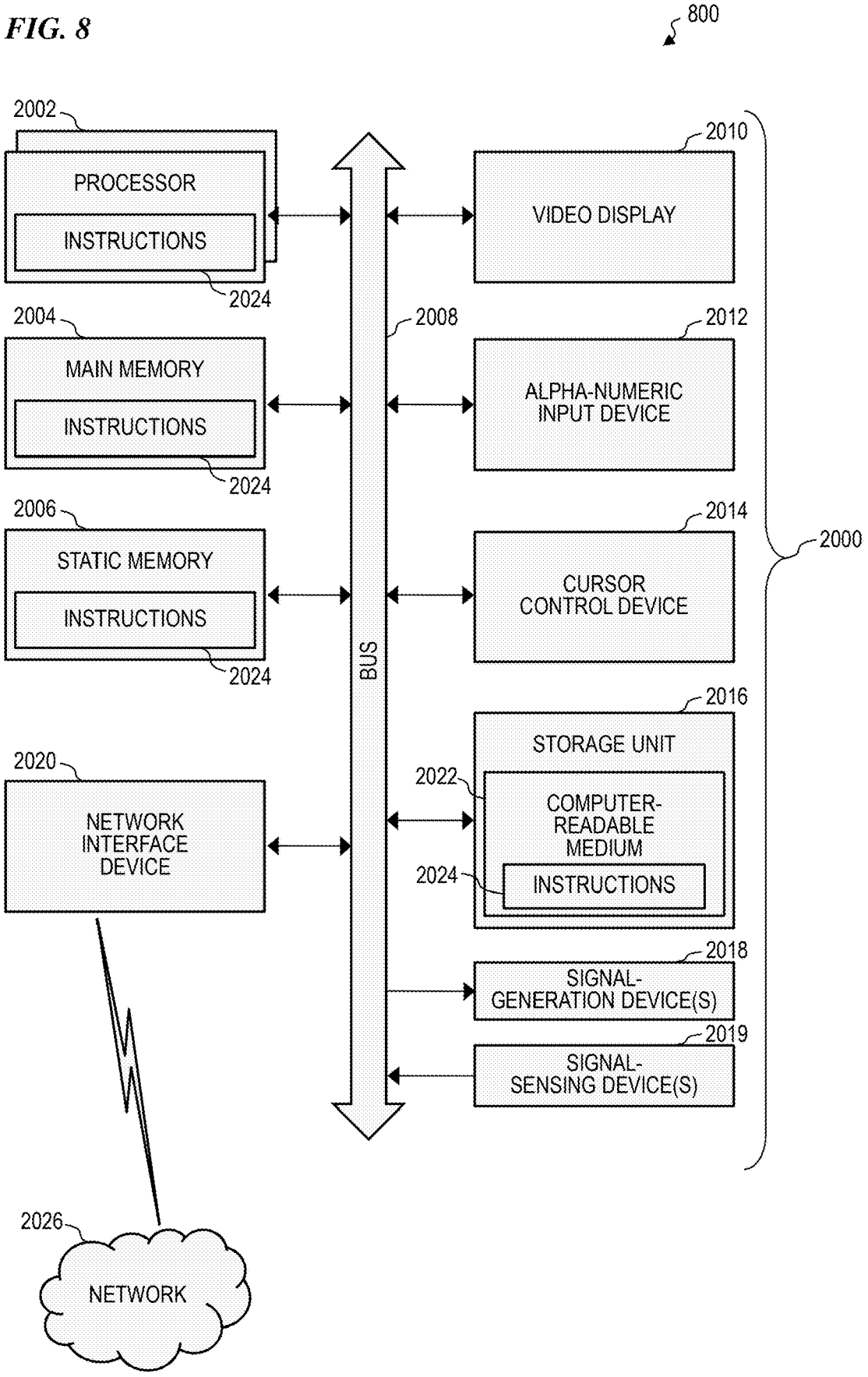
FIG. 8 is a diagrammatic representation 800 of a computing device for a machine in the example electronic form of a computer system, according to an example embodiment, suitable for the control system present in some embodiments of the invention.

FIG. 8 is a block diagram of a computing device 800 for a machine. In this example, it is an electronic form of a computer system 2000, according to an example embodiment. In various example embodiments, the machine operates as a stand-alone device or can be connected (e.g., networked) to other machines (such as in network 2026 in the cloud that hosts cloud services). In a networked deployment, the machine can operate in the capacity of a server or a client machine in a server-client network environment, or as a peer machine in a peer-to-peer (or distributed) network environment. The computer system 2000 can be a personal computer (PC), a tablet PC, a set-top box (STB), a Personal Digital Assistant (PDA), a cellular telephone, a portable music player (e.g., a portable hard-drive audio device such as a Moving Picture Experts Group Audio Layer 3 (MP3)

player, a web appliance, a network router, a switch, a bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. In some embodiments, the computer is an enterprise-class computer.

In some embodiments, the present invention includes a crib comprising: a frame; one or more adjustable-height sidewalls connected to the frame, wherein the sidewalls are selectively raise-able to impart motion of the sidewalls relative to the membrane; a body support platform; one or more membranes connected to the body support platform, wherein one or more of the membranes extend over the sidewalls; a membrane dispensing system operably coupled to the frame and configured to selectively collect or release a membrane from the frame, wherein the membrane is connected to the membrane dispensing system and extends from the membrane dispensing system over the sidewalls and is configured to support the mattress within the one or more sidewalls, wherein the membrane dispensing system selectively collects or releases the membrane in order to raise or lower the mattress within the sidewalls to a selected one of a plurality of different heights.

In some embodiments, one or more edges of one or more of the membranes are non-movably affixed to the base.

In some embodiments, the height of the sidewalls is not adjustable.

In some embodiments, the invention further provides one or more actuators operably coupled to the one or more adjustable-height sidewalls and configured to raise or lower the sidewalls.

In some embodiments, the invention further provides one or more actuators operably coupled to the membrane, and configured to collect or release material.

In some embodiments, the invention further provides a controller operably coupled to the movable portions of the crib, configured to effect motion of those portions.

In some embodiments, the controller further comprises sensors to monitor the safety, condition, and disposition of the occupant. In some embodiments, sensors included in the controller include one or more of: visual-light cameras; infrared cameras; infrared switches; magnetic switches, contact switches; vibration sensors; olfactory sensors; motor electric current sensors; strain sensors; and pressure sensors.

In some embodiments, the controller is provided with a network interface device.

In some embodiments, the controller is provided with an alarm for alerting parents or caretakers.

In some embodiments, wherein the membrane includes one or more of: a fabric; a polymer sheet; and an elastomeric sheet.

In some embodiments, the invention further provides locking mechanisms that selectively prevent relative motion of the membrane, frame, and sidewalls.

In some embodiments, the invention includes a chair comprising: a frame; one or more adjustable-height sidewalls connected to the frame, wherein the sidewalls are selectively raise-able to impart motion of the sidewalls relative to the membrane; a body support platform; one or more membranes connected to the body support platform, wherein one or more of the membranes extend over the sidewalls; a means by which the outer edge of the membrane can be collected or released to impart a motion relative to the sidewalls.

In some embodiments, the body support platform is configured to be tilted by selective motion of one or both of the sidewalls and the membrane.

In some embodiments, the invention provides a method for providing adjustability to furniture, consisting of: providing a body support platform; providing one or more adjustable-height sidewalls; providing a frame; suspending the body support platform from one or more membranes by extending the membranes over the sidewalls and affixing them to the frame; effecting a raising or lowering of the body support platform by imparting motion to the membrane by raising and lowering the sidewalls; and effecting a raising or lowering of the body support platform by imparting motion to the membrane by collecting and dispensing membrane material from the frame.

In some embodiments, the invention further provides a method of imparting rotational and lateral motion to the body support platform by selectively imparting motion to different portions of the membrane or different membranes by: selective motion of the sidewalls; or selectively dispensing or collecting different portions of the membrane or different membranes; or a combination thereof.

In some embodiments, the invention further provides a method wherein adjusting the furniture comprises moving the adjustable elements by means of powered actuators.

In some embodiments, the invention further provides a method of automatically controlling the powered actuators by providing a control system.

In some embodiments, the invention further provides a method of monitoring the occupant and adjusting the furniture according to the occupant's condition and disposition.

In some embodiments, the invention further provides a method of monitoring the safety and wellness of the occupant and raising an alarm upon detecting a hazard.

In some embodiments the present invention includes a crib for holding an occupant, wherein the crib includes: a frame; one or more adjustable-height sidewalls connected to the frame, wherein the sidewalls are selectively raisable or lowerable to impart motion of the sidewalls relative to the frame; a body support platform; one or more membranes connected to the body support platform, wherein the one or more membranes extend from the body support platform over the sidewalls to outside of the sidewalls; and a membrane dispensing system operably coupled to the frame and configured to selectively collect or release the one or more membranes from the frame, wherein the one or more membranes are connected to the membrane dispensing system and extend from the membrane dispensing system over the sidewalls, to support the body support platform within the one or more sidewalls, and the membrane dispensing system selectively collects or releases the membrane in order to raise or lower the body support platform within the sidewalls to a selected one of a plurality of different heights.

In some embodiments, one or more edges of the one or more membranes are non-movably affixed to the frame.

In some embodiments, the height of the sidewalls is continuously adjustable.

Some embodiments further include a controller and one or more sidewall actuators operably coupled to the one or more adjustable-height sidewalls, wherein the controller is configured to control the one or more sidewall actuators to raise or lower the sidewalls in order to raise or lower the body support platform.

Some embodiments further include a controller and one or more dispensing actuators operably coupled to the one or more membranes, wherein the controller is configured to control the dispensing actuators to collect or release the one or more membranes in order to raise or lower the body support platform.

Some embodiments further include: a controller; one or more sidewall actuators operably coupled to raise and lower the one or more adjustable-height sidewalls one or more dispensing actuators operably coupled to the one or more membranes, wherein the controller is configured to control the one or more sidewall actuators and the one or more dispensing actuators to collect or release the one or more membranes in order to raise or lower the body support platform.

In some embodiments the controller includes sensors to monitor safety of the occupant.

In some embodiments, the sensors include one or more of: visual-light cameras, infrared cameras, infrared switches, magnetic switches, contact switches, vibration sensors, olfactory sensors, motor electric current sensors, strain sensors, and pressure sensors.

In some embodiments, the controller includes a network interface device configured to elicit and receive software updates for the controller.

In some embodiments the controller includes an alarm for alerting parents or caretakers.

In some embodiments, the membrane includes one or more of: a fabric, a polymer sheet, and an elastomeric sheet.

Some embodiments further include locking mechanisms that selectively prevent relative motion of the membrane, frame, and sidewalls.

In some embodiments, the present invention provides a chair, the chair including: a frame; one or more adjustable-height sidewalls connected to the frame, wherein the sidewalls are selectively raisable to impart motion of the sidewalls relative to the membrane; a body support platform; one or more membranes connected to the body support platform, wherein one or more of the membranes extend over the sidewalls; and a means by which the outer edge of the membrane can be collected or released to impart a motion of the body support platform relative to the frame.

In some embodiments, the body support platform is configured to be tilted by selective motion of: at least one of the sidewalls; or at least one of the one or more membranes; or at least one of the sidewalls and at least one of the one or more membranes.

In some embodiments the present invention provides a method for providing adjustability to furniture. This method includes providing a body support platform; providing one or more adjustable-height sidewalls; providing a frame; providing a membrane dispensing system providing one or more membranes operably coupled to the membrane dispensing system suspending the body support platform from the one or more membranes by extending the membranes over the sidewalls and affixing the one or more membranes to the membrane dispensing system operably coupled to the frame; raising or lowering the body support platform by selectively collecting or releasing material of the one or more membranes from the membrane dispensing system.

Some embodiments further include raising or lowering the body support platform by raising or lowering the one or more sidewalls under the one or more membranes.

Some embodiments further include rotationally or laterally moving to the body support platform by selectively moving different portions of the one or more membrane by: selectively moving the sidewalls; or selectively dispensing or collecting various portions of the one or more membranes; or both selectively moving the sidewalls and selectively dispensing or collecting various portions of the one or more membranes.

Some embodiments further include further automatically controlling powered actuators.

Some embodiments further include monitoring an occupant of the furniture and adjusting the furniture according to a condition or orientation of the occupant.

Some embodiments further include monitoring safety and wellness of an occupant and raising an alarm upon detecting a safety hazard.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first, " "second," and "third," etc., are used merely as labels, and are not intended to impose numerical requirements on their objects.

What is claimed is:

1. A furniture apparatus with adjustable platform height and membrane sidewalls for holding an occupant, the apparatus comprising:

a frame;

one or more sidewalls connected to the frame, wherein the one or more sidewalls are adjustable-height sidewalls;

a body-support platform that is at least partially surrounded by the one or more sidewalls;

one or more membranes connected to the body-support platform, wherein the one or more membranes extend from the body-support platform over the one or more sidewalls to outside of the one or more sidewalls;

a membrane-motion system operably coupled to the frame and configured to selectively move at least part of one or more of the one or more membranes relative to the one or more sidewalls, wherein the one or more membranes extend over the sidewalls, to support the body-support platform within the one or more sidewalls, and the membrane-motion system selectively moves the at least part of one or more of the one or more membranes in order to raise or lower the body-support platform to a selected one of a plurality of different heights;

a controller; and one or more sidewall actuators operably coupled to the one or more adjustable-height sidewalls, wherein the controller is configured to control the one or more sidewall actuators to raise or lower the sidewalls in order to raise or lower the body support platform.

2. The apparatus of claim 1, wherein the furniture apparatus is a chair for holding a person.

3. The chair of claim 2, wherein the chair is configured to tilt the body-support platform by selective motion of at least one of:

the one or more adjustable-height sidewalls; or the one or more membranes; or the sidewalls and at least one of the one or more membranes.

4. The apparatus of claim 1, wherein the membrane includes a fabric.

5. The apparatus of claim 1, wherein the controller includes one or more sensors to monitor safety of the occupant of the apparatus.

6. The apparatus of claim 1, wherein the controller includes a network-interface device, wherein the network-interface device is configured to elicit and receive software updates for the controller.

7. The apparatus of claim 1, wherein the controller is provided with an alarm for alerting parents or caretakers of the occupant of the apparatus.

8. A furniture apparatus with adjustable platform height and membrane sidewalls for holding an occupant, the apparatus comprising:

a frame;

one or more sidewalls connected to the frame;

a body-support platform that is at least partially surrounded by the one or more sidewalls;

one or more membranes connected to the body-support platform, wherein the one or more membranes extend from the body-support platform over the one or more sidewalls to outside of the one or more sidewalls;

a membrane-motion system operably coupled to the frame and configured to selectively move at least part of one or more of the one or more membranes relative to the one or more sidewalls, wherein the one or more membranes extend over the sidewalls, to support the body-support platform within the one or more sidewalls, and the membrane-motion system selectively moves the at least part of one or more of the one or more membranes in order to raise or lower the body-support platform to a selected one of a plurality of different heights;

a controller; and one or more dispensing actuators operably coupled to the one or more membranes, wherein the controller is configured to control the dispensing actuators to collect or release the one or more membranes in order to raise or lower the body support platform.

9. The apparatus of claim 8, wherein the body-support platform has a circumference, and wherein an entirety of the circumference is connected to the one or more membranes.

10. The apparatus of claim 8, wherein the one or more dispensing actuators operably coupled to the one or more membranes form a membrane-dispensing system operably coupled to the frame and configured to selectively collect or release at least part of one or more of the one or more membranes from the frame, wherein the one or more membranes are connected to the membrane-dispensing system and extend from the membrane-dispensing system over the sidewalls to support the body-support platform.

11. The apparatus of claim 8, wherein a height of the sidewalls is continuously adjustable.

12. The apparatus of claim 8, wherein the one or more sidewalls are adjustable-height sidewalls, the apparatus further comprising:

one or more sidewall actuators operably coupled to raise and lower the one or more adjustable-height sidewalls; and wherein the controller is configured to control the one or more sidewall actuators and the one or more dispensing actuators to collect or release the one or more membranes in order to raise or lower the body-support platform.

13. The apparatus of claim 8, wherein the controller includes one or more sensors to monitor safety of the occupant of the apparatus.

14. The apparatus of claim 8, wherein the controller includes a network-interface device, wherein the network-interface device is configured to elicit and receive software updates for the controller.

15. The apparatus of claim 8, wherein the controller is provided with an alarm for alerting parents or caretakers of the occupant of the apparatus.

16. The apparatus of claim 8, wherein the membrane includes a fabric.

17. The apparatus of claim 8, further comprising one or more locking mechanisms that selectively prevent motion of the one or more membranes relative to the one or more sidewalls.

18. The apparatus of claim 8, wherein the membrane includes a polymer sheet.

19. The apparatus of claim 8, wherein the membrane includes an elastomeric sheet.

20. A method for adjusting a furniture piece that includes a body-support platform, a plurality of sidewalls, a frame, a membrane-motion system, and one or more membranes, the method comprising:

suspending the body-support platform from the one or more membranes by extending the membranes over the sidewalls and affixing the one or more membranes to the membrane-motion system operably coupled to the frame; and raising or lowering the body support platform by selectively collecting or releasing material of the one or more membranes by the membrane-motion system;

rotationally or laterally moving the body-support platform by selectively moving different portions of the one or more membranes by:

selectively moving the sidewalls; or selectively dispensing or collecting various portions of the one or more membranes; or both selectively moving the sidewalls and selectively dispensing or collecting various portions of the one or more membranes, and further including automatically controlling powered actuators.

21. The method of claim 20, further including raising or lowering the body-support platform by raising or lowering the one or more sidewalls under the one or more membranes.

22. The method of claim 20, further including monitoring an occupant of the furniture piece and adjusting the furniture piece according to a condition or orientation of the occupant.

23. The method of claim 20, further including monitoring safety and wellness of an occupant and raising an alarm upon detecting a safety hazard.

* * * * *